US007401972B2

(12) United States Patent
Gilbert et al.

(10) Patent No.: US 7,401,972 B2
(45) Date of Patent: Jul. 22, 2008

(54) ON CHIP DILUTION SYSTEM

(75) Inventors: John R. Gilbert, Brookline, MA (US); Manish Deshpande, Canton, MA (US)

(73) Assignee: Cytonome, Inc., Watertown, MA (US)

( * ) Notice: Subject to any disclaimer, the term of this patent is extended or adjusted under 35 U.S.C. 154(b) by 320 days.

(21) Appl. No.: 11/059,196

(22) Filed: Feb. 15, 2005

(65) Prior Publication Data

US 2005/0148082 A1 Jul. 7, 2005

Related U.S. Application Data

(62) Division of application No. 10/183,726, filed on Jun. 25, 2002, now Pat. No. 6,883,957.

(60) Provisional application No. 60/379,185, filed on May 8, 2002.

(51) Int. Cl.
*B01F 5/00* (2006.01)

(52) U.S. Cl. ..... 366/152.2; 366/160.1; 366/182.4; 73/1.36

(58) Field of Classification Search ... 366/152.1–152.4, 366/182.4, 160.1, DIG. 1–DIG. 4; 137/4, 137/88–93, 605, 606, 896, 897; 73/1.01, 73/1.16, 1.36
See application file for complete search history.

(56) References Cited

U.S. PATENT DOCUMENTS 3,109,631 A 11/1963 Purjahn
3,266,780 A 8/1966 Waters
4,186,607 A * 2/1980 Porter et al. ..... 73/61.55
4,964,732 A 10/1990 Cadeo et al.
5,312,595 A 5/1994 Moffett et al.
5,869,004 A 2/1999 Parce et al.
5,961,930 A 10/1999 Chatterjee et al.
6,004,515 A 12/1999 Parce et al.
6,086,740 A 7/2000 Kennedy
6,114,122 A 9/2000 Besemer et al.
6,149,870 A 11/2000 Parce et al.
6,213,151 B1 4/2001 Jacobson et al.
6,235,431 B1 5/2001 Takechi et al.
6,235,471 B1 5/2001 Knapp et al.
6,238,538 B1 5/2001 Parce et al.
6,271,038 B1 8/2001 Liu et al.
6,296,020 B1 10/2001 McNeely et al.
6,368,871 B1 4/2002 Christel et al.
6,403,338 B1 6/2002 Knapp et al.
6,406,893 B1 6/2002 Knapp et al.
6,883,957 B2 4/2005 Gilbert et al.
2003/0198576 A1 * 10/2003 Coyne et al. ..... 422/100

* cited by examiner

*Primary Examiner*—David L Sorkin
(74) *Attorney, Agent, or Firm*—Lahive & Cockfield, LLP

(57) ABSTRACT

An on-chip chemical compound dilution system for providing dilution of a chemical compound in a microfluidic application includes at least one sample well for providing a selected chemical compound to be diluted, a dilution well for providing a diluent for diluting the chemical compound, a network of channels for carrying the chemical compound and diluent, a first syringe pump for effecting dilution, a second syringe pump, a detector and a plurality of valves for selectively controlling the flow of liquid through the channels. The dilution system may be a multiple-stage dilution system for precisely mixing a plurality of chemical compounds in a diluent. The dilution system allows for accurate calibration to compensate for variations due to manufacturing, thereby providing precise dilution ratios. The dilution system further enables flushing to allow re-use of the system with another chemical compound.

13 Claims, 6 Drawing Sheets

ON CHIP DILUTION SYSTEM

RELATED APPLICATIONS

The present application is a Divisional of U.S. patent application Ser. No. 10/183,726, filed Jun. 25, 2002, entitled "On Chip Dilution System", now U.S. Pat. No. 6,883.957, issued Apr. 26, 2005, which, in turn, claims priority to U.S. Provisional Patent Application No. 60/379,185 filed May 8, 2002 entitled "On Chip Dilution System", the contents of both of which are herein incorporated by reference.

FIELD OF THE INVENTION

The present invention relates to a sample dilution system for diluting chemical compounds in a microfluidic system.

BACKGROUND OF THE INVENTION

In the chemical, biomedical, bioscience and pharmaceutical industries, it has become increasingly desirable to perform large numbers of chemical operations, such as reactions, separations and subsequent detection steps, in a highly parallel fashion. The high throughput synthesis, screening and analysis of (bio)chemical compounds, enables the economic discovery of new drugs and drug candidates, and the implementation of sophisticated medical diagnostic equipment. Of key importance for the improvement of the chemical operations required in these applications are an increased speed, enhanced reproducibility, decreased consumption of expensive samples and reagents, and the reduction of waste materials.

Microfluidic devices and systems provide improved methods of performing chemical, biochemical and biological analysis and synthesis. Microfluidic devices and systems allow for the performance of multi-step, multi-species chemical operations in chip-based micro chemical analysis systems. Chip-based microfluidic systems generally comprise conventional 'microfluidic' elements, particularly capable of handling and analyzing chemical and biological specimens. Typically, the term microfluidic in the art refers to systems or devices having a network of processing nodes, chambers and reservoirs connected by channels, in which the channels have typical cross-sectional dimensions in the range between about 1.0 μm and about 500 μm. In the art, channels having these cross-sectional dimensions are referred to as 'microchannels'.

In many microfluidic applications, dilution of chemical compounds, with a diluent is desirable or required. However, precise mixing of one or more chemical compounds in a diluent is often difficult, due to the difficulty in accurately controlling and calibrating the amount of compound or diluent in the dilution process.

SUMMARY OF THE INVENTION

The present invention provides an on-chip chemical compound dilution system for providing dilution of a chemical compound in a microfluidic application. The chemical compound dilution system includes at least one sample well for providing a selected chemical compound to be diluted, a dilution well for providing a diluent for diluting the chemical compound, a network of channels for carrying the chemical compound and diluent, a first syringe pump for effecting dilution, a second syringe pump, a detector and a plurality of valves for selectively controlling the flow of liquid through the channels. The dilution system may be a multiple-stage dilution system for precisely mixing a plurality of chemical compounds in a diluent.

The dilution system allows for accurate calibration to compensate for variations due to manufacturing, thereby providing precise dilution ratios. The dilution system further enables flushing to allow re-use of the system with another chemical compound.

According to a first aspect of the invention, a dilution system for diluting a chemical compound is provided. The dilution system comprises a sample well for providing a chemical compound, a dilution well for providing a diluent, a dilution channel for transmitting the diluent, a sample channel for transmitting the chemical compound to the dilution channel to form a diluted chemical compound and a variable flow valve for varying the flow of diluent through the dilution channel, thereby varying a ratio of the diluent to the chemical compound in the diluted chemical compound.

According to another aspect, a calibrated sample dilution system is provided, comprising a sample well for providing a known chemical standard, a dilution well for providing a diluent a dilution channel for transmitting the diluent, a sample channel for transmitting the known chemical standard to the dilution channel to form a diluted chemical standard, a high precision variable flow valve for varying the flow of diluent through the dilution channel, wherein the variable flow valve has a plurality of settings corresponding to different dilution ratios and a detector for analyzing the diluted chemical standard to determine a ratio of diluent to known chemical standard in the diluted chemical standard. The detector is used to calibrate the flow valve to correlate a setting on the variable flow valve to the determined ratio of diluent to known chemical standard in the diluted chemical standard.

According to another aspect, a method of forming a calibrated on-chip dilution system is provided. The method comprises providing a dilution system comprising a sample well for providing a chemical compound, a dilution well for providing a diluent, a dilution channel for transmitting the diluent, a sample channel for transmitting the chemical compound to the dilution channel to form a diluted chemical compound, a variable flow valve for controlling the flow of diluent through the dilution channel and a detector for analyzing the diluted chemical standard and calibrating the variable flow valve to correlate a setting on the variable flow valve to a dilution ratio for the system.

According to yet another aspect of the invention, a dilution system for diluting a plurality of chemical compounds is provided. The dilution system comprises a first dilution module, a second dilution module and a bi-stable valve. The first dilution module comprises a first sample well for providing a first chemical compound, a first dilution well for providing a first diluent, a first dilution channel for transmitting the first diluent, a first sample channel for transmitting the first chemical compound to the first dilution channel to form a first diluted chemical compound, and a first variable flow valve for varying the flow of diluent through the dilution channel. The second dilution module comprises a second dilution channel for receiving the first diluted chemical compound, a second sample well for providing a second chemical compound, a second sample channel for transmitting the second chemical compound to the second dilution channel to mix the second chemical compound with the diluted first chemical compound to form a diluted mix, and a second variable flow valve for regulating the flow of the second chemical compound. The bi-stable valve selectively blocks flow between the first dilution module and the second dilution module.

According to a final aspect, a variable flow valve for regulating liquid flow through a channel is provided. The variable flow valve comprises an aperture formed in a side wall of the channel, a membrane covering the aperture and an external actuator for deflecting the membrane through the aperture a predetermined amount to vary the resistance of the channel to flow. The actuator comprises a base and a cylindrical head for contacting the membrane.

DETAILED DESCRIPTION OF THE INVENTION

The present invention provides an on-chip dilution system for diluting a chemical compound on a microfluidic chip. The present invention will be described below relative to an illustrative embodiment. Those skilled in the art will appreciate that the present invention may be implemented in a number of different applications and embodiments and is not specifically limited in its application to the particular embodiments depicted herein.

Figure 1:
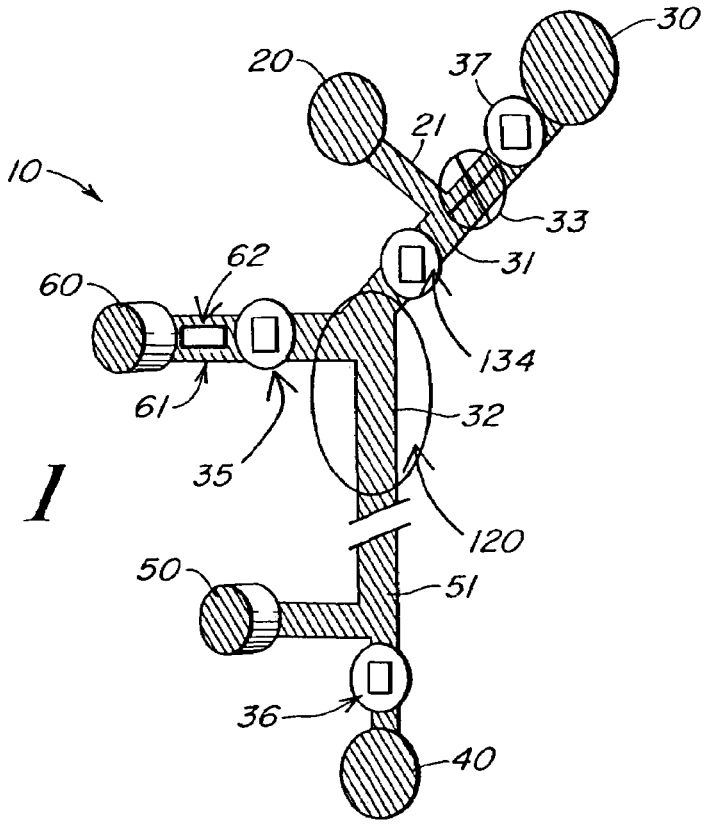
FIG. 1 is a schematic view of the on-chip chemical compound dilution system of an illustrative embodiment of the present invention.

FIG. 1 is a schematic view of the chemical compound dilution system according to one embodiment of the invention. The chemical compound dilution system 10 provides precise control over dilution ratios at relatively small volumes. According to an illustrative embodiment, the chemical compound dilution system has a target dilution ratio of between about 1 and about 10, though one skilled in the art will recognize that the invention is not limited to this range. The chemical compound dilution system 10 includes a sample well 20 for storing a supply of a selected chemical compound to be diluted and a dilution well 30 containing a suitable diluent for diluting the chemical compound. The system includes a first dilution channel 31 for conveying the diluent from the dilution well 30 through the system and a sample channel 21 for transmitting the chemical compound from the sample well 20 to the first dilution channel 31. According to the illustrative embodiment, the dilution channel provides diluent at a rate that is between about one about ten times the rate at which the sample channel supplies chemical compound. As shown, the sample channel 21 intersects the first dilution channel 31, such that the chemical compound from the sample well combines with the diluent provided by the dilution well 30, thereby diluting the chemical compound by a selected amount to form a diluted chemical compound.

The dilution system 10 further includes an intermediate well 40 providing substantially constant pressure for access to dilution. A first syringe pump 50, or other constant flow source, and a second syringe pump 60, or other constant flow source, are also provided for pulling flow from the sample well 20 and the dilution well 30 through the first dilution channel and a second dilution channel 51, which forms an aliquot region to perform a dilution of the chemical compound. According to the illustrative embodiment, the second dilution channel 51 has a length L that is relatively long to reduce, inhibit or prevent transient startup effects. The second syringe pump 60 is connected to a detector channel 61 for receiving a diluted chemical compound and a detector 62 for measuring a ratio of the chemical compound to diluent in the diluted chemical compound in the detector channel 61. One skilled in the art will recognize that any suitable detector 62 and detection methodology may be utilized to analyze the diluted chemical compound, including, but not limited to, electrochemical analysis, dielectrophoresis, fluorescence and surface plasma resonance (SPR).

The chemical compound dilution system 10 further includes a plurality of switches and valves for controlling the flow of liquid through the channels. According to the illustrative embodiment, the first dilution channel 31 includes a variable flow valve 33 for accurately controlling the flow rate of the diluent from the dilution well. The variable flow valve 33 provides analog control of flow resistance through the first dilution channel 31 before the intersection of the first dilution channel 31 and the sample channel 21. The dilution system 10 further includes a plurality of externally actuated on-off valves 34, 35, 36, 37 for selectively blocking the flow of liquid through the channels. The first on-off valve 34 controls the flow of the diluted chemical compound through the first dilution channel. The second on-off valve 35 controls the flow of the diluted chemical compound through the detection channel 61. The third on-off valve 36 is located in the second dilution channel and controls the flow of liquid from the intermediate well 40. The fourth on-off valve 37 is positioned between the dilution well 30 and the intersection with the sample channel 21. The fourth on-off valve 37 controls the flow of the diluent through the first dilution channel 31. Valves 34, 35 and 36 define an aliquot region 12 in the dilution system 10 for holding a preloaded amount of diluent prior to operation.

According to an illustrative embodiment, the on-off valves comprise bubble valves for controlling liquid flow by the introduction of a gas bubble into the channel interior. A suitable on-off valve for implementation in the present invention is described in U.S. Provisional Patent Application 60/373,256 filed Apr. 17, 2002 entitled "Microfluidic System Including a Bubble Valve for Regulating Fluid Flow Through a Microchannel" and U.S. patent application entitled "Microfluidic System Including a Bubble Valve for Regulating Fluid Flow Through a Microchannel" filed herewith. The contents of both applications are herein incorporated by reference. One skilled in the art will recognize that any suitable valve for regulating the flow of liquid through a channel may be utilized according to the teachings of the present invention.

Figure 2A:
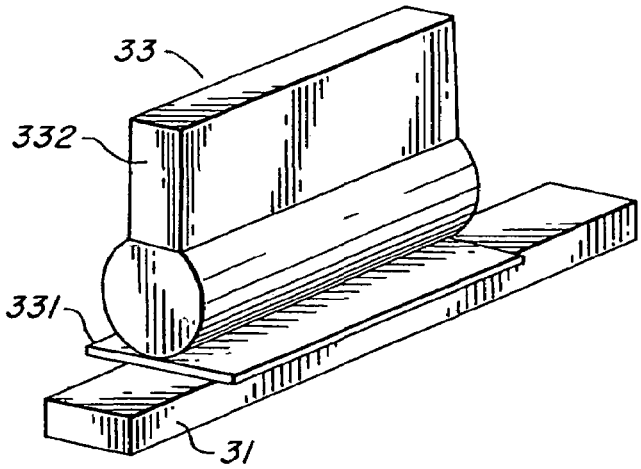
FIGS. 2*a* and 2*b* illustrate an embodiment of a variable flow valve suitable for implementing in the chemical compound dilution system of FIG. 1.
Figure 2B:
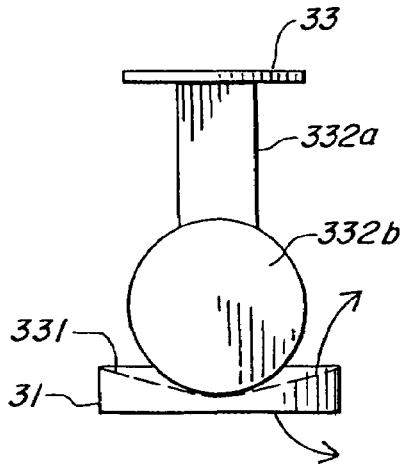

FIGS. 2*a* and 2*b* illustrate the variable flow valve 33 of FIG. 1. The variable flow valve 33 varies the resistance of an associated channel to regulate the flow of liquid through the channel. The illustrative variable flow valve 33 provides precise analog control of liquid flow through the channel. The valve includes a flexible membrane 331 covering an aperture formed in a sidewall of the channel, illustrated as the first dilution channel 31, and an external actuator 332 for deflecting the membrane 331 into the channel interior by a selected amount to vary the resistance of the channel to flow. The amount of deflection of the membrane controls the flow rate of the diluent through the channel. According to an illustrative embodiment, the actuator 332 is a PZT, stepper, pin or other suitable device for varying the position of the membrane. The actuator 332 has a base 332*a* and a cylindrical shaped head 332*b* that extends along the length of the channel. Alternatively, the actuator head comprises a linear edge that contacts the membrane 331. The actuator 332 may be located off-chip and may be reusable, allowing for a compact, low-cost structure. The variable flow valve precisely and reproducibly controls the amount of diluent that is supplied to the chemical compound and thus the ratio of chemical compound to diluent in the resulting diluted chemical compound.

Figure 3A:
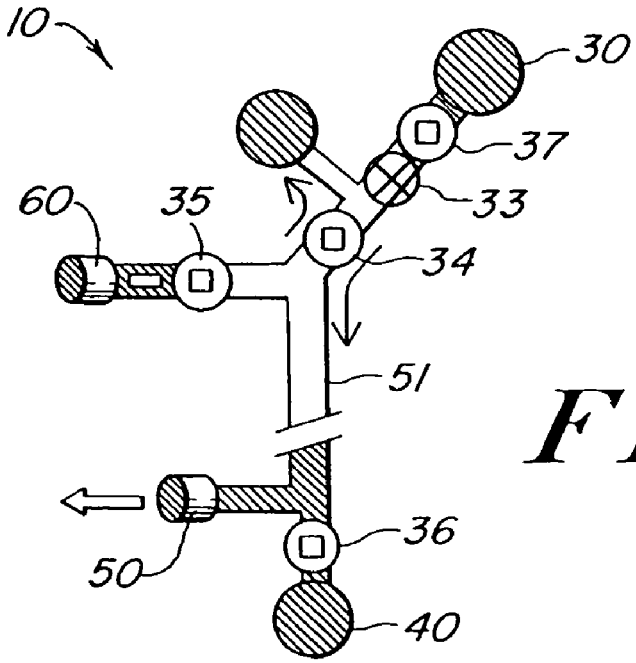
FIGS. 3*a* and 3*b* illustrate the chemical compound dilution system of FIG. 1 in operation.
Figure 3B:
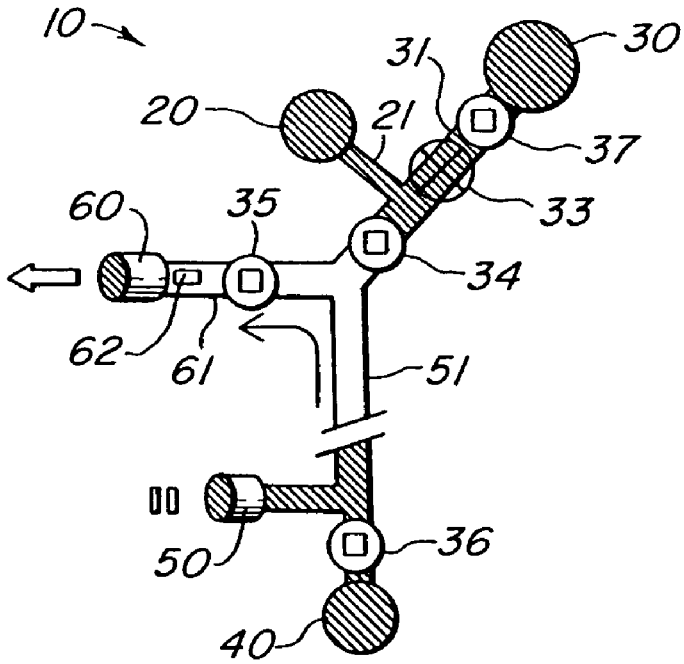

The operation of the chemical compound dilution system is shown in FIGS. 3*a* and 3*b*. In a first step, shown in FIG. 3*a*, the first on-off valve 34 opens to allow dilution at a ratio specified by the position of the variable valve 33. The second on-off valve 35 is closed to create the aliquot region 12 for collection of diluted chemical compound. As shown, the intermediate well 40 and the aliquot region 12 are preloaded with the diluent. Dilution is effected with the first syringe pump 50, which pulls the chemical compound and the diluent from their respective wells and through the dilution channels 31, 51 at selected ratios to form a diluted chemical compound. The ratio of the chemical compound to diluent in the diluted chemical compound is precisely controlled by the variable valve 33.

In a second step, illustrated in FIG. 3*b*, the diluted chemical compound is detected. As shown, the first on-off valve 34 closes to prevent flow of the diluted chemical compound back through the first dilution channel 31. The third on-off valve 36 opens and the first syringe pump 50 is stopped at a specific point to create a constant pressure reservoir in the aliquot region to facilitate mixing of the chemical compound and diluent. The second on-off valve 35 is then opened and the second syringe pump 60 pulls the diluted chemical compound through the detection channel 61 out over the detector 62.

Figure 4:
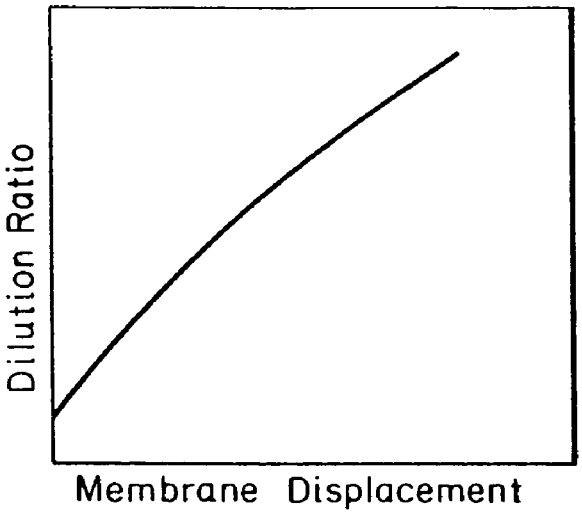
FIG. 4 illustrates an example of a numerical model of dilution curve generated during calibration mode.

Prior to operation, the dilution system 10 is calibrated to provide accurate, reproducible control of flow resistances. The ability to perform calibration of a microfluidic chip containing the dilution system 10 before use compensates for and eliminates manufacturing variance and provides high precision dilution despite variations in channel configurations. The dilution system is calibrated by repeating the operation procedure, illustrated in FIGS. 3*a* and 3*b* with a known standard chemical compound, which is stored in the sample well 20. The displacement of the variable valve 33 is controllably varied to result in different dilution ratios. The dilution ratios can be determined by examining the diluted chemical compound over the detector 62 and a numerical model of dilution curve, shown in FIG. 4, can be fit or specific dilution points can be calibrated and stored. In this manner, the relationship between the dilution ratio and the displacement of the membrane in the variable flow valve 33 may be precisely determined.

Figure 5:
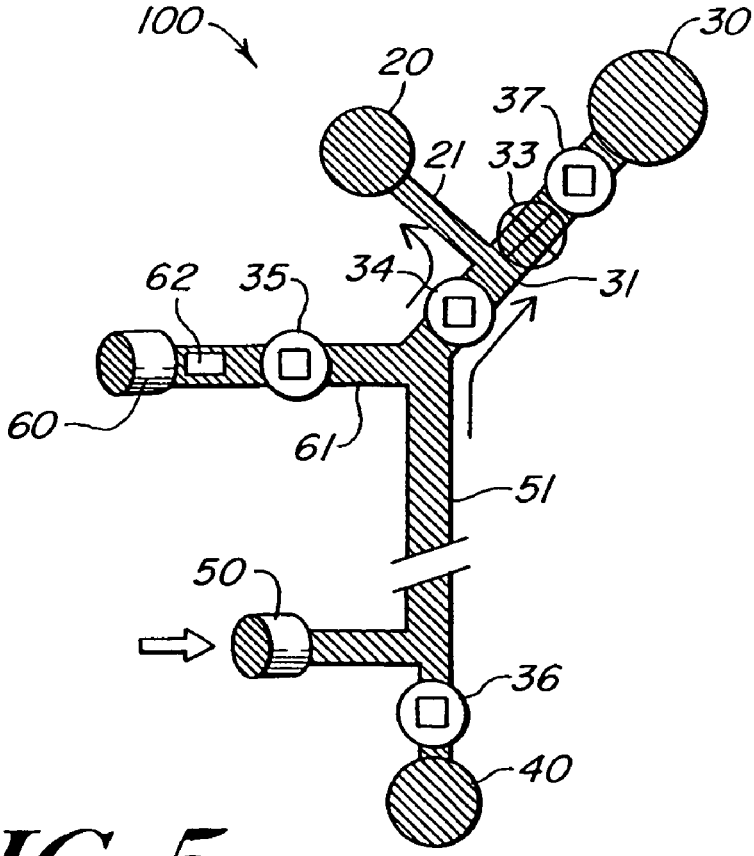
FIG. 5 illustrates the chemical compound dilution system of FIG. 1 during flushing mode.

After operation, the dilution system 10 may be flushed to allow dilution of a new chemical compound. To flush the sample well, as shown in FIG. 5, the first on-off valve 34 opens to allow flow of diluent from the aliquot region 12 back up to the sample well 20. The fourth on-off valve 37 is closed to prevent flow into the dilution well 30 and force flow into the sample well 20. Diluent in the aliquot region from the first syringe pump 50 flushes the sample well 20 and fills the chip with diluent to flush the chemical compound from the system and prepare the chip for re-use. The chemical compound in the sample well 20 may then be replaced. The fourth on-off valve 37 may then be opened to allow dilution of the second chemical compound by the method described above. This method may be used in conjunction with known aspiration and dispensing equipment for injection of a new chemical compound into the sample well 20.

According to an alternate embodiment, a third syringe pump may be provided in communication with the first dilution channel to provide flushing.

According to another embodiment of the invention, a multiple-stage chemical compound dilution system is provided for precisely mixing a plurality of chemical compounds in a diluent. For example, a two-stage dilution system 100, shown in FIG. 6, includes a second sample well 201 and a second variable valve 3300. The two-stage dilution system 100 includes a first stage for diluting a first chemical compound and a second stage for injecting a second chemical compound into the diluted first chemical compound. The first stage includes a sample well 200, a sample channel 210, a dilution well 300, a first dilution channel 310, a second dilution channel 510, a first syringe pump 500, a intermediate well 400, a first variable valve 303 and a plurality of on-off valves 340, 350, 360, 370 for diluting a first chemical compound from the first sample well 200 with a diluent from the dilution well 300 by the method described above. The second variable valve enables precise mixing of the second chemical compound in the second sample well with the diluted chemical compound from the first stage. The operation of the valves, in particular the variable valves 3300 and 330 in the two-stage dilution system 100, is independent. Each valve is independently calibrated and operates in different time phases.

Figure 7A:
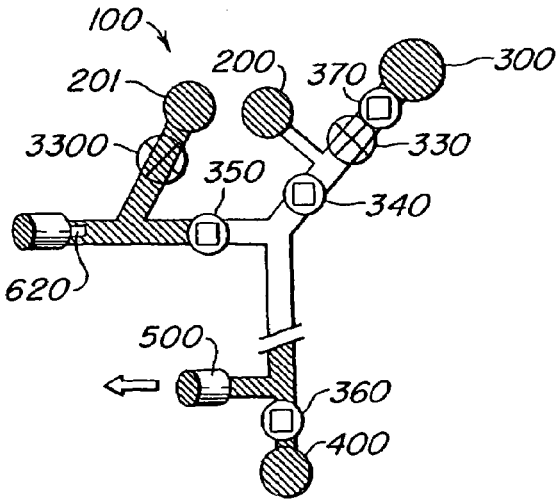
FIGS. 7*a* and 7*b* illustrate the chemical compound dilution system of FIG. 6 in operation.
Figure 7B:
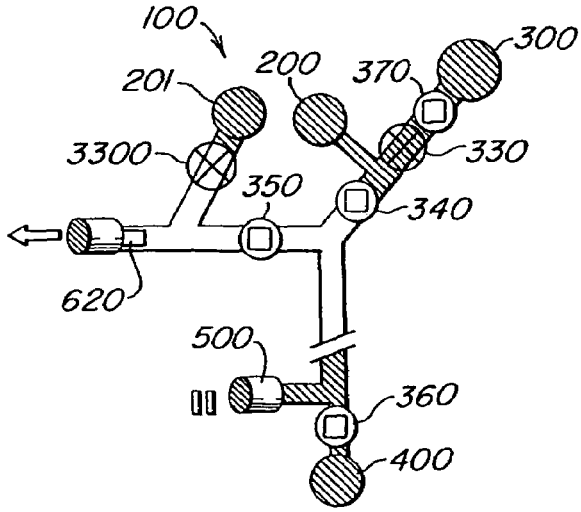

The operation of the two-stage dilution system is illustrated in FIGS. 7*a* and 7*b*. In the first step, shown in FIG. 7*a*, the first on-off valve 340 opens to allow dilution at a selected ration that is specified by the position of the first variable flow valve 330. The second on-off valve 350 is closed to create the aliquot region for collection of the diluted chemical compound and the intermediate well 400 and the aliquot region 120 of the two-stage dilution system 100 are preloaded with diluent, similarly to the single-stage dilution system of FIG. 1. Dilution of the first chemical compound with the diluent is actuated by the first syringe pump 500.

In the second step, shown in FIG. 7*b*, the first on-off valve 340 closes to block fluid flow through the first dilution channel 310. The third on-off valve 360 opens and the first syringe pump 500 is stopped at a specific point to create a constant pressure reservoir. The second on-off valve 350 is then opened and the second syringe pump 600 pulls the diluted first chemical compound through the detection channel 610. The second variable valve 3300 is actuated to flow the second chemical compound from the second sample well 201 to enable precise mixing of the second chemical compound and the diluted first chemical compound in the detection channel 610. The position second variable valve 330 is selected to produce a precise ratio of the second chemical compound to the first chemical compound. The combined first and second diluted chemical compounds are then detected by the detector 620.

Figure 8A:
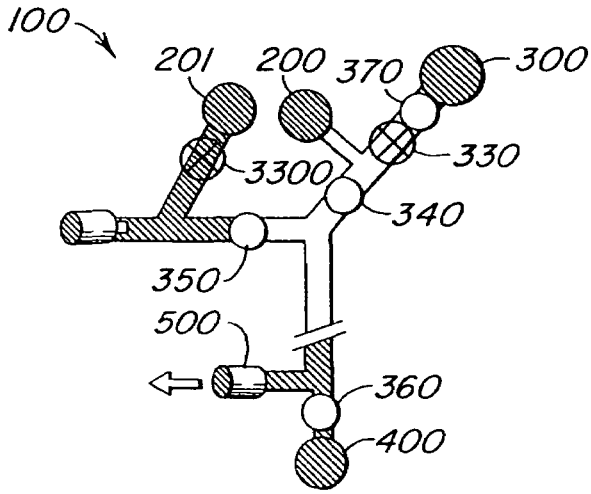
FIGS. 8*a*-8*d* illustrate the chemical compound dilution system of FIG. 6 during calibration.
Figure 8B:
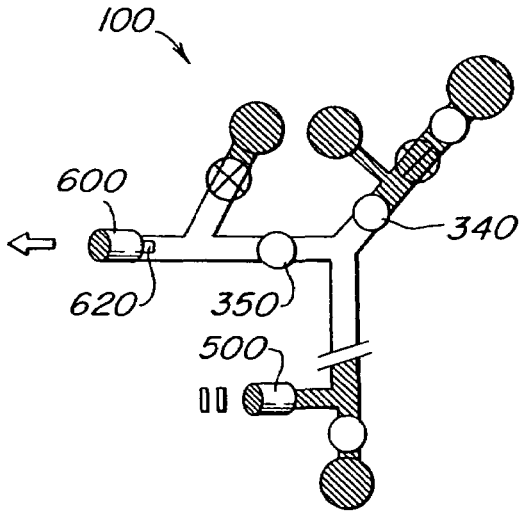

The calibration of the two-stage dilution system 100 is illustrated in FIGS. 8*a*-8*d*. In step 1, shown in FIGS. 8*a* and 8*b*, calibration of the second variable flow valve 3300 is performed. The first sample well 200 and the diluent well 300 are filled with pure diluent and the second sample well 201 is filled with a selected known chemical compound. The first variable flow valve is fully open to allow free flow through the first dilution channel 310. The second on-off valve 350 is closed to define the aliquot region 120 and the syringe pump 500 draws pure diluent into the aliquot region 120. Then, as shown in FIG. 8*b*, the second on-off valve 350 opens and the first on-off valve 340 closes to allow the diluent to mix with the known second chemical compound in the detection channel 610. The resulting diluted second chemical compound then flows over the detector 620, which measures the ratio of the known second chemical compound to diluent. The displacement of the second variable flow valve 3300 is varied and the ratio measured. The process is repeated and the results graphed to determine a relationship between the position of the flow valve and the ratio of chemical compound to diluent. In this manner, valve setting may be determined for a desired ratio of chemical compound to diluent.

Figure 8C:
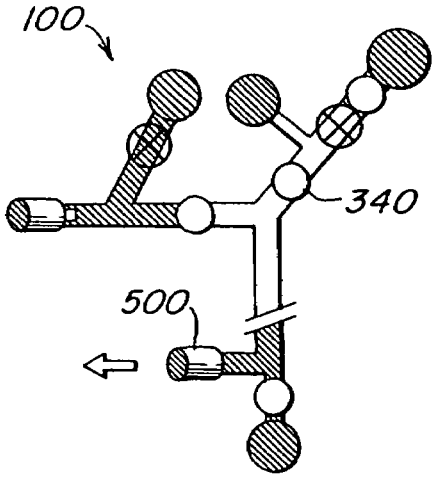
Figure 8D:
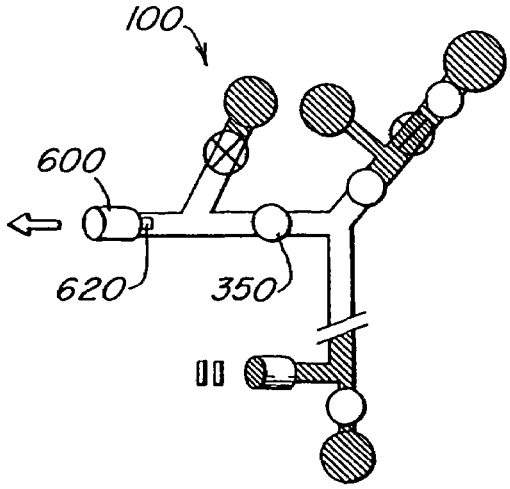

In step two, shown in FIGS. 8*c* and 8*d*, calibration of the first variable flow valve 330 is performed. In the second step, the first sample well is filled with a known standard and the dilution well 300 is filled with pure diluent. The second variable flow valve 3300 is set to any point calibrated in the first step, described above and the first variable flow valve 330 is set to a desired calibration point. The second on-off valve 350 is closed to create the aliquot region and the first syringe pump 500 pulls the first chemical compound from the first sample well 200 into the aliquot region 120. Then the second on-off valve 350 is opened and the first on-off valve is closed to allow the diluted first chemical compound to mix with the known second chemical compound (based on the first step ratio calibration). The resulting combined diluted chemical compound then flows to the detector 620, which measures the ratio of the first chemical compound to the diluent, based on the known ratio of the second chemical compound. The displacement of the first variable flow valve is varied and the process repeated to create a calibration curve or to determine a required first variable valve setting for a desired ratio of chemical compound to diluent.

Figure 6:
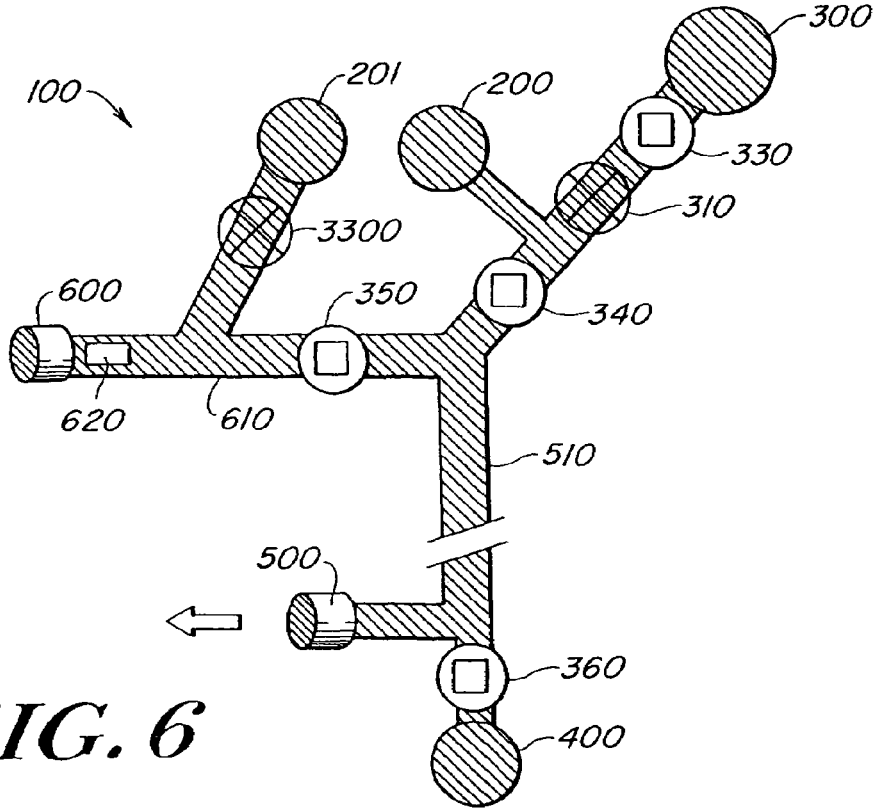
FIG. 6 illustrates a two-stage chemical compound dilution system according to an alternate embodiment of the invention.
Figure 9:
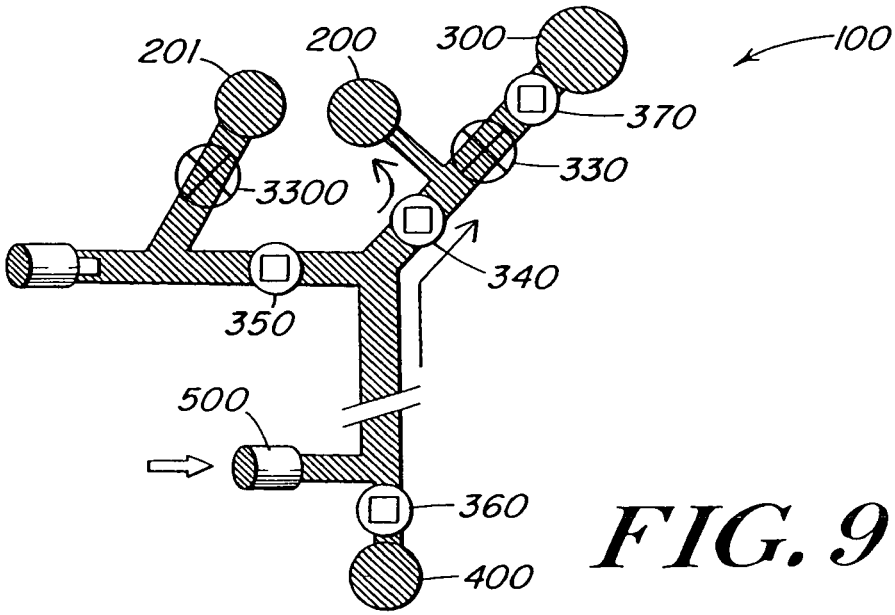
FIG. 9 illustrates the chemical compound dilution system of FIG. 6 during flushing mode.

FIG. 9 illustrates the process of flushing the two-stage dilution system 100 of FIG. 6. To flush the system 100, the first on-off valve opens to allow flow from the aliquot region back up to the sample wells 200, 201. The fourth on-off valve closes to force flow of the diluent into the first sample well 200. The diluent from the aliquot region from the first sample well 200 flushes the chemical compound well and fills the chip with diluent, to prepare the system for re-use. The chemical compound is replaced and the fourth on-off valve opens to allow for dilution of the new chemical compound.

Figure 10:
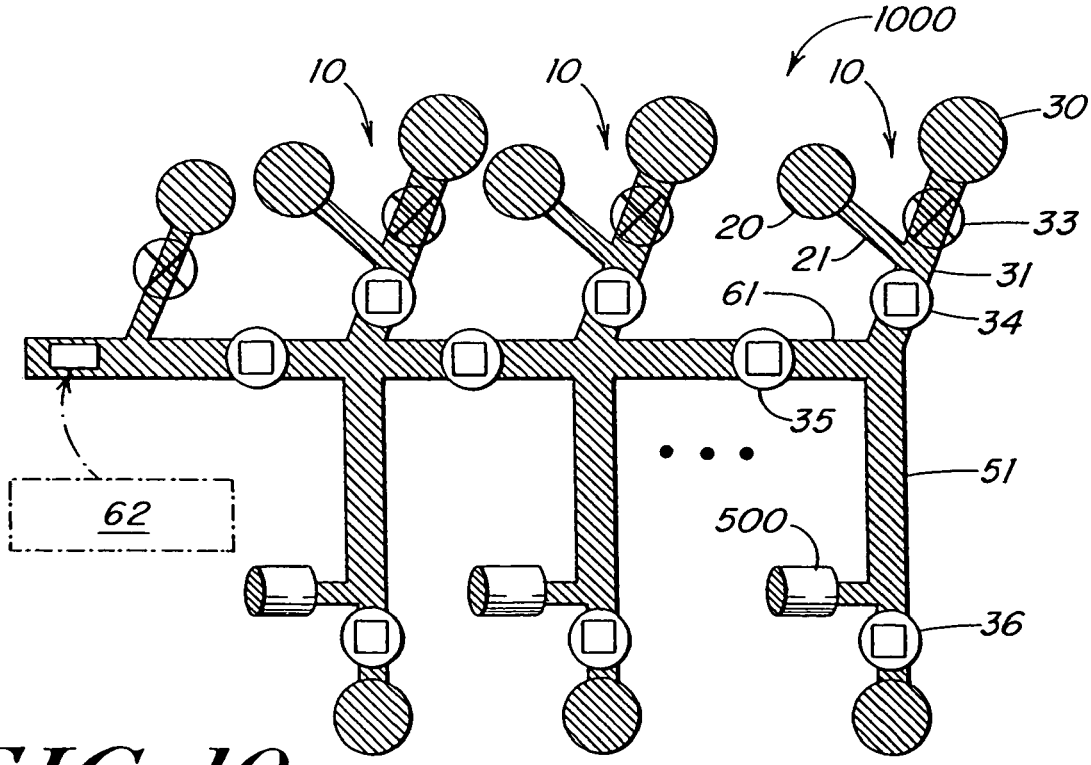
FIG. 10 illustrates a multiple-stage chemical compound dilution system according to an alternate embodiment of the invention.

According to another embodiment, a multiple-stage dilution system may be used to precisely combine and dilute multiple chemical compounds. An example of such a system 1000 is shown in FIG. 10. The multiple-stage dilution system 1000 includes a multiple single stage dilution cells 10 in series, including an on-off valve to separate each stage from the next. As shown, each cell includes a dilution well 30, a sample well 20, a sample channel, a syringe pump 50, a first dilution channel 31, a second dilution channel 51, a detection channel, a variable flow valve 33, and a plurality of on-off valves 34, 35, 36 for selectively blocking flow through a channel. Each cell 10 is individually calibrated to ensure precise dilution ratios within each cell and mixing ratios between the different cells. The variable flow valve operations with the cells are segregated and independent from each other.

The dilution system of the present invention provides significant advantages and improvements over the prior art. The use of the variable flow valves provides precise control over the dilution ratios. The cost of the on-chip dilution system is relatively low and the components relatively simple and easy to manufacture. The calibration scheme ensures reproducibility and uniformity beyond what can be achieved with microfabrication alone.

The present invention has been described relative to an illustrative embodiment. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

The invention claimed is:

1. A method for diluting a sample, comprising:

providing a dilution system having:

a sample well for holding chemical standard;

a dilution well for providing a diluent;

a dilution channel for transmitting the diluent;

a sample channel for transmitting the chemical standard to the dilution channel to form a diluted chemical standard;

a high precision variable flow valve for varying the flow of diluent through the dilution channel, wherein the variable flow valve has a plurality of settings corresponding to different dilution ratios; and a detector capable measuring the ratio of standard chemicals to diluent when chemical standards are introduced into the system through the sample well;

setting the variable flow valve to a first setting corresponding to a first dilution ratio;

introducing the chemical standard into the sample well to cause dilution of the chemical standard at the first dilution ratio; and measuring a ratio of the chemical to diluent using the detector.

2. The method of claim 1, wherein the variable flow valve comprises:

an aperture formed in a side wall of the dilution channel;

a membrane covering the aperture; and an external actuator for deflecting the membrane through the aperture a predetermined amount to vary the resistance of the channel to flow.

3. The method of claim 2, wherein the external actuator comprises a base and a cylindrical head for contacting the membrane.

4. The method of claim 1, further comprising the step of introducing a second chemical to the system, wherein the second chemical mixes with the first diluted chemical.

5. The method of claim 1, further comprising the step of creating an aliquot region for mixing the diluent and chemical.

6. The method of claim 5, wherein the aliquot region is formed by a plurality of on-off valves.

7. The method of claim 1, further comprising the steps of:

setting the variable flow valve to a second setting corresponding to a second dilution ratio; and introducing a chemical into the system to cause dilution of the chemical at the second dilution ratio.

8. A method of calibrating an on-chip dilution system, comprising:

providing a dilution system comprising a sample well for providing a chemical compound, a dilution well for providing a diluent, a dilution channel for transmitting the diluent, a sample channel for transmitting the chemical compound to the dilution channel to form a diluted chemical compound, a variable flow valve for controlling the flow of diluent through the dilution channel and a detector for analyzing the diluted chemical compound; and calibrating the variable flow valve to correlate a setting on the variable flow valve to a dilution ratio for the system.

9. The method of claim 8, wherein the step of calibrating comprises the steps of:

providing a known chemical standard in the sample well;

providing a diluent in the dilution well;

setting the variable flow valve to a first setting;

diluting the known chemical standard with diluent to form a diluted chemical standard having a first dilution ratio;

detecting the diluted chemical standard to determine the first dilution ratio; and correlating the first setting to the first dilution ratio.

10. The method of claim 9, wherein the step of calibrating further comprises:

setting the variable flow valve to a second setting;

diluting the known chemical standard with diluent to form a diluted chemical standard having a second dilution ratio;

detecting the diluted chemical standard to determine the second dilution ratio; and correlating the second setting to the second dilution ratio.

11. The method of claim 10 further comprising the step of generating a calibration curve graphing a relationship between a plurality of settings of the variable flow valve and the dilution ratio for the system.

12. The method of claim 8, wherein the variable flow valve comprises an aperture formed in a side wall of the dilution channel, a membrane covering the aperture and an external actuator for deflecting the membrane through the aperture a predetermined amount to vary the resistance of the dilution channel to flow.

13. The method of claim 12, wherein the step of calibrating comprises determining a relationship between the dilution ratio of the system and an amount of deflection of the membrane in the variable flow valve.

* * * * *